United States Patent [19]

Geelen

[11] Patent Number: 4,887,364

[45] Date of Patent: Dec. 19, 1989

[54] DEVICE FOR COOLING AND/OR DRYING BULK GOODS

[75] Inventor: Pierre M. L. Geelen, Haelen, Netherlands

[73] Assignee: Geelen Techniek B.V., Haelen, Netherlands

[21] Appl. No.: 199,909

[22] Filed: May 27, 1988

[30] Foreign Application Priority Data

Jun. 5, 1987 [NL] Netherlands ..... 8701318
Nov. 23, 1987 [NL] Netherlands ..... 8702798

[51] Int. Cl.[4] ..... F26B 17/00

[52] U.S. Cl. ..... 34/57 C; 34/57 A; 34/57 B

[58] Field of Search ..... 34/57 A, 57 R, 57 B, 34/62

[56] References Cited

U.S. PATENT DOCUMENTS

| | | | |
|---|---|---|---|
| 3,571,946 | 5/1971 | Essen et al. | 34/57 A |
| 4,090,852 | 5/1978 | Dowd | 34/57 A |
| 4,379,368 | 4/1983 | Keller | 34/57 R |
| 4,402,143 | 9/1983 | Shuly et al. | 34/57 R |
| 4,530,169 | 7/1985 | Okawara | 34/57 B |

FOREIGN PATENT DOCUMENTS

| | | | |
|---|---|---|---|
| 74489 | 4/1984 | Japan | 34/57 A |
| 538203 | 3/1975 | U.S.S.R. | 34/57 A |

*Primary Examiner*—Henry A. Bennet
*Assistant Examiner*—John Sollecito
*Attorney, Agent, or Firm*—Oblon, Spivak, McClelland, Maier & Neustadt

[57] ABSTRACT

Disclosed is to a device for cooling and/or drying bulk goods, provided with a bunker having a supply opening for the material to be cooled, the supply opening being located near the upper side of the bunker, and with a single grate construction located near the bottom side of the bunker. The grate construction is provided with a number of bar-shaped members extending at least substantially parallel to each other. Further there is a mechanism for supplying cooling and/or drying air to the interior of the bunker through the grate construction at the bottom side of the device and for discharging the air near the upper side of the device after it has flowed through the material. The bar-shaped members can be pivoted forwards and backwards about a center position during operation and are provided with plate-shaped parts extending along both sides of the longitudinal axes, the plate-shaped parts being arranged such that they overlap each other during normal operation. The center position of the bar-shaped members is adjustable and the bar-shaped members with the plate-shaped parts fixed thereto can be pivoted forwards and backwards in any set center position. Preferably the plate-shaped parts are perforated.

7 Claims, 2 Drawing Sheets

DEVICE FOR COOLING AND/OR DRYING BULK GOODS

BACKGROUND OF THE INVENTION

1. Field of the Invention

The invention relates to a device for cooling and/or drying bulk goods, provided with a bunker having a supply opening for the material to be cooled, said supply opening being located near the upper side of the bunker, and with a single grate construction located near the bottom side of the bunker, said grate construction being provided with a number of bar-shaped means extending at least substantially parallel to each other, as well as with means for supplying cooling and/or drying air to the interior of the bunker through the grate construction at the bottom side of the device and for discharging said air near the upper side of the device after it has flowed through the material, while the bar-shaped means can be pivoted forwards and backwards about a centre position during operation.

2. Discussion of the Background

The dimensions of the products which are processed in a device of this type, such as mealy products, granular products, flaky products, cylindrical products etc., can vary within ample margins. Usually the varying dimensions of the products also require varying dimensions of the passages present between the parts of the gate construction for passing the material. With the known grate construction the dimension of said passages can usually not be adjusted, however, so that a certain grate construction can usually be used for a certain material only and when another and/or finer and/or coarser material is to be processed it is necessary to use another device or to build in another grate in a certain device.

SUMMARY OF THE INVENTION

The purpose of the invention is to obtain a device of the above kind which is suitable for processing a large number of different bulk goods.

According to the invention this can be achieved in that the bar-shaped means are provided with plate-shaped parts extending along both sides of the longitudinal axes, said plate-shaped parts being arranged such that they can overlap each other during normal operation, while the centre position of the bar-shaped means is adjustable and the bar-shaped means with the plate-shaped means fixed thereto can be pivoted forwards and backwards in any set centre position.

The passages for passing the material bounded by the overlapping plate-shaped parts can be adjusted in a simple manner by changing the centre position of the bar-shaped means, while in every centre position an even discharge of the products to be processed can be ensured because of the possibility to pivot the bar-shaped means with the plate-shaped parts fixed thereto forwards and backwards.

It is noted that from British patent specification 9801/1912 there is known a drying device provided with a large number of floors arranged at relatively short distances above one another, said floors being built up of partly overlapping tiltable plates. Drying air is supplied between said floors and can flow out via passages provided between the plates. At set intervals the plates forming a floor will be tilted in order to deposit the material present thereon onto a floor located thereunder. Thus the material will be moved in steps from the one floor to the next floor. From said publication there is not knwon, however, a device provided with a bunker for taking up the bulk goods and with a single grate construction located near the bottom side of the bunker, built up of bar-shaped means, which bar-shaped means can be pivoted forwards and backwards during operation in order to be able to ensure a regular outflow of the material from the bunker. Nor can an indication be found in said publication with regard to a possible adjustment of the device for processing various kinds of materials.

From the German patent specification 318,693 there is known a similar drying device, provided with a number of floors located at short distances above one another, said floors being built up of a large number of plate-shaped parts which may overlap one another. The plates are jointly pivotable thereby from the position in which they form a floor into a position in which the material lying on a floor falls in one movement onto a floor located thereunder. There is no indication provided in this publication, therefore, with regard to the construction of a drying device provided with a bunker containing the material to be processed and a single grate construction located at the bottom side thereof, as constructed in accordance with the proposal according to the present invention.

In some cases problems may arise when fine products, such as mealy products, are processed when non-perforated plate-shaped parts are used because, also when the plate-shaped parts are set such that only narrow gaps are present between adjacent plate-shaped parts, so much air is still sucked in through the gaps that local passages are formed in the layer of meal or the like material supported by the plate-shaped parts.

As a result there may be a very irregular distribution of the air speed and an irregular degree of flow of air through the meal or the like material on the surface of the grate construction in such a case.

According to a further aspect of the invention such a disadvantage can be met in that the plate-shaped parts are perforated.

When using such perforated plate-shaped parts it will be possible, when meal or like fine material is processed, to locate the plate-shaped parts so that the edges of the plate-shaped parts are at least substantially in contact with one another, and it is practically only possible for the air to flow through the perforations during operation, as a result of which an even passage of air through the material to be processed can be ensured.

BRIEF DESCRIPTION OF THE DRAWINGS

The invention will be further explained hereinafter with reference to an embodiment of the construction according to the invention diagrammatically illustrated in the accompanying figures.

DETAILED DESCRIPTION OF THE PREFERRED EMBODIMENT

Figure 1:
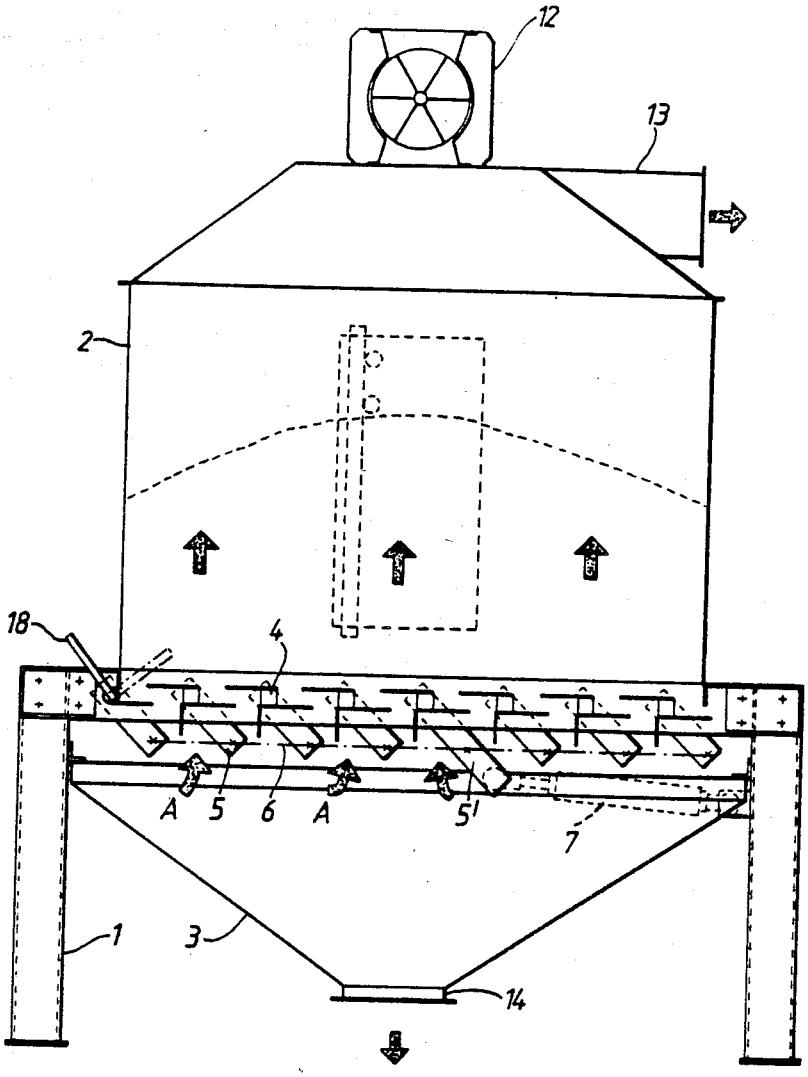
FIG. 1 is a diagrammatic view of a device according to the invention.

The device illustrated in FIG. 1 comprises a frame 1 on which there is placed a bunker 2. Under the bunker there is located a chute 3 supported by the frame. Between the bunker 2 and the chute 3 there is arranged a grate construction, which is built up of a number of bars 4 extending parallel to each other, which bars are rotatably journalled near their ends in bearings, not shown, fixed to the frame, such that the bars 4 are pivotable about their longitudinal axes. To the ends of the bars 4 there are furthermore fitted arms 5 which are mutually coupled by a coupling rod 6 only diagrammatically indicated by means of a chain-dotted line. One of the arms 5' is longer than the other arms 5 and is coupled, with its end remote from the relevant bar-shaped means 4, to the piston rod of a setting cylinder 7, which setting cylinder is coupled to the frame with its other end. During operation the bar-shaped means 4 can be pivoted forwards and backwards about their longitudinal axes by means of the setting cylinder 7.

As is also further illustrated in FIG. 2 three plate-shaped parts 9–11, extending along the entire length of the bar-shaped means, are fixed to each bar-shaped means 4. As appears from the figures thereby the two plate-shaped parts 9 and 10 extend parallel to and spaced from each other because they are located on both sides of the bar-shaped means 4 in question and thereby extend in opposite directions from said bar-shaped means 4. The third plate-shaped means 11 may be perpendicular to the two plate-shaped parts 9 and 10 and extends downwards in the position of the plate-shaped parts illustrated in FIG. 1.

At its upper side the bunker 2 is provided with a cellular valve 12, via which bulk goods to be processed can be supplied to the interior of the bunker.

Cold or hot air for cooling and/or drying can be supplied to the interior of the bunker 2 via the grate formed by the bar-shaped means 4 with the plates 9–11 fixed thereto, as indicated by means of the arrows A and, after having flowed through the material present in the bunker 2, be discharged via a pipe 13 connected to the upper side of the bunker 2. Material which has flowed from the bunker 2 into the chute 3 through the grate-shaped means can be discharged via a spout 14 provided at the bottom side of the chute 3.

Figure 2A:
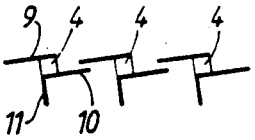
FIGS. 2*a–c* illustrates a few bar-shaped means according to a first embodiment of the invention in three different positions.

As is illustrated in FIG. 2*a* the bar-shaped means 4 forming a grate can be pivoted such that the free ends of the overlapping parts 9 and 10 of adjacent bar-shaped means substantially touch each other or are located at short distances from each other, such that the gaps still present between the plate-shaped parts 9 and 10 of the grate-shaped construction are too small to pass the material, so that no flow of the material from the bunkers is possible.

Figure 2B:
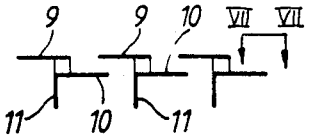
Figure 2C:
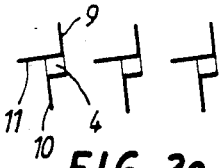
Figure 3A:
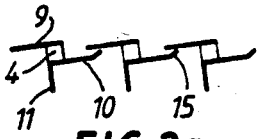
FIGS. 3*a–c*–5*a–c* illustrate a few further embodiments of the bar-shaped means, each illustrated in three different positions.
Figure 3B:
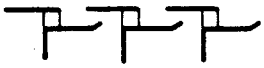
Figure 3C:
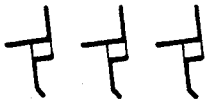

From the position of the bar-shaped means illustrated in FIG. 2*a*, in which the outlet from the bunker will be at least substantially closed, the bar-shaped means can be pivoted to an intermediate position illustrated in FIG. 2*b*, in which the distance between the overlapping plate-shaped means is such that the material present in the bunker 2 can flow out via the gap present between the plate-shaped means.

In order to start and stop said outflow the bar-shaped means 4 can thereby be pivoted at an angle about the set intermediate position or centre position by means of the setting cylinder 7, as a result of which the material lying on the plate-shaped means 9 will undergo a slight upward and downward movement. In particular when products which tend to stick are processed such a displacement of the material in order to loosen the material is important. The bunker above the grate construction may be slightly conical towards the top, which will prevent bridge formation in the material in the bunker.

Because in the centre position illustrated in FIG. 2*b* the free end of the plate-shaped part 10 across which the material flows out of the bunker is located a short distance from the plate-shaped part 11 extending perpendicularly to said plate-shaped part 10, which plate-shaped part 11 extends some distance under the edge of the plate-shaped part 10, the material is prevented from flowing out of the bunker too quickly, because the material is braked, as it were, by the plate-shaped part 11.

At the same time the plate-shaped part 11 contributes to the rigidity of the bar-shaped means 4 in order to prevent bending of said bar-shaped means 4 under the influence of the weight of the material present in the bunker.

When it is desired to empty the bunker quickly the bar-shaped means can be pivoted from the position of the grate illustrated in FIG. 2*a* or *b* at an angle of about 90°, so that the plate-shaped parts 9 and 10 extend at least substantially vertically, while there is a relatively large gap present between the free boundary edge of a plate-shaped part 11 located substantially horizontally in that case and an adjacent bar-shaped means 4. Thus large passages are formed between the adjacent bar-shaped means 4, through which the material can flow out freely and without impediment. A little material at the very most will remain behind on the plate-shaped parts 11 located substantially horizontally in that case, but this material will also be discharged when the bar-shaped means are pivoted back towards the closed position of FIG. 2*a*.

As illustrated in greater detail in FIGS. 3*a–c*–5*a–c*the shape of the plate-shaped means may possibly be adapted to the nature of the products which will mainly be processed in the device. Thus, in the embodiment according to FIGS. 3*a–c*, the ends 15 of the plate-shaped parts 10 are bent upwards a little in the direction of the plate-shaped parts 9 located thereabove. As a result of this the gap between the overlapping plate-shaped parts can be reduced in a simple manner in the closed position of the grate.

Figure 4A:
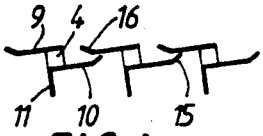
Figure 4B:
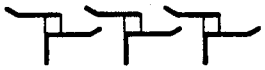
Figure 4C:
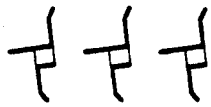

In the embodiments according to FIGS. 4*a–c* only the edges 15 of the plate-shaped parts 10, but also the edges 16 of the plate-shaped parts 9 are bent upwards. The upwardly bent edges of the plate-shaped parts 9 will thereby have an extra scraping effect on the material in the bunker 2 when the bar-shaped means are pivoted forwards and backwards during operation.

Figure 5A:
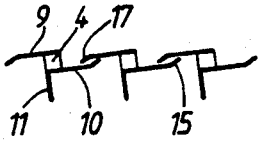
Figure 5B:
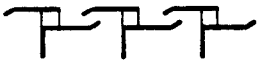
Figure 5C:
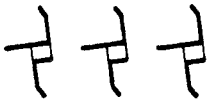

In the embodiment according to FIGS. 5*a–c*, on the contrary, the edges 17 of the plate-shaped parts 9 are bent downwards, in order to prevent that, for example small spherical products flow through the grate in the so-called closed position of the grate.

There should always remain an opening between plate parts 9 and 10 for the passage of the air.

Figure 6:
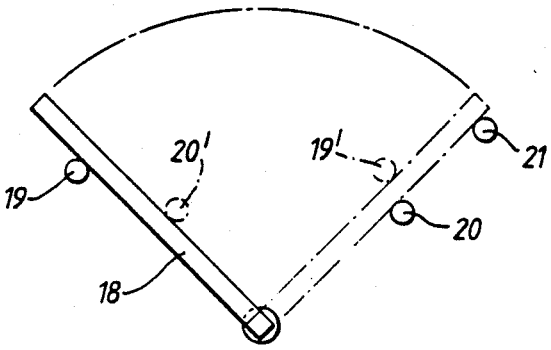
FIG. 6 diagrammatically illustrates a part of a mechanism for regulating the pivoting of the bar-shaped means about their longitudinal axes.

FIG. 6 illustrates a part of a mechanism for regulating the stroke of the setting cylinder 7 or the angle at which the bar-shaped means are pivoted during operation.

For that purpose an arm 18 is fixed to one of the bar-shaped means 4, which arm co-operates with a pair of switches 19 and 20 arranged on both sides of the arm. The switch 19 is thereby movable in a horizontal direction and is adjustable between the position 19 and the position 19' illustrated by dotted lines. In a similar manner the switch 20 is adjustable in a horizontal direction between the position 20 and the position 20' illustrated by dotted lines.

When the arm 18 touches one of the switches the direction of rotation of the bar-shaped means will be reversed via a mechanism (not shown). It will be apparent that the angle at which the bar-shaped means are pivoted and the place of said angle can be influenced by adjusting the switches 19 and 20. A further switch 21, having a fixed arrangement and co-operating with the arm, is used for stopping the pivoting motion when the bar-shaped means 4 have been put in the completely open position, as is e.g. illustrated in FIG. 2*c*.

For processing very fine products, e.g. meal, it is desirable to perforate at least those parts of the plate-shaped parts that project from the bar-shaped means.

Figure 7:
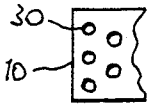
FIG. 7 is a partial cross-sectional view taken along line VII—VII in FIG. 2*b*.

When the plate-shaped parts 9 and 10 are then pivoted into such a position that the free edges of adjacent plate-shaped parts at least substantially rest on each other, the air supplied will mainly be supplied to the layer of material lying above the plate-shaped means 9 and 10 exclusively via the perforations 30 as shown in FIG. 7, so that a very even distribution of air over the grate surface is obtained.

For the discharge of material the plate-shaped parts can be pivoted at desired moments to a position in which the material can flow out through the gaps formed between the plate-shaped parts.

The bars 4 may be hollow and perforated, so that a supply of air over practically the entire grate surface can be created.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A device for cooling and/or drying bulk goods, which comprises:

a bunker having a supply opening for material to be cooled, said supply opening being located near an upper side of the bunker;

a single grate construction located near a bottom side of the bunker, said grate construction including a plurality of bar-shaped means extending at least substantially parallel to each other;

means for supplying cooling and/or drying air to an interior portion of the bunker through the grate construction at the bottom side of the bunker and for discharging said air near the upper side of the bunker after said air has flowed through the material;

means for pivoting the bar-shaped means forwards and backwards about a centre position during operation, wherein the bar-shaped means comprise plate-shaped parts extending along both sides of longitudinal axes of said bar-shaped means, said plate-shaped parts being arranged so as to overlap each other during normal operation, and means for adjusting the centre position of the bar-shaped means and wherein the bar-shaped means with the plate-shaped means fixed thereto is pivotable forwards and backwards in any of a plurality of predetermined centre positions.

2. A device according to claim 1, wherein the plate-shaped parts are perforated.

3. A device for cooling and/or drying bulk goods, which comprises:

a bunker having a supply opening for material to be cooled, said supply opening being located near an upper side of the bunker;

a single grate construction located near a bottom side of the bunker, said grate construction including a plurality of bar-shaped means extending at least substantially parallel to each other;

means for supplying cooling and/or drying air to an interior portion of the bunker through the grate construction at the bottom side of the bunker and for discharging said air near the upper side of the bunker after said air has flowed through the material;

means for pivoting the bar-shaped means forwards and backwards about a centre position during operation, wherein the plate-shaped parts of bar-shaped means are arranged side by side; and means for positioning said plate-shaped parts so as to at least substantially join each other wherein the plate-shaped parts are perforated.

4. A device according to claims 1 or 2, wherein at least one of said plate-shaped parts extend downwards during normal operation at a predetermined distance from and under a boundary edge of at least one of the remaining overlapping plate-shaped parts, which part forms part of an adjacent bar-shaped means.

5. A device according to claims 1 or 2, wherein said plate-shaped parts comprise first and second plate-shaped parts fixed to the bar-shaped means and extending parallel to each other, which extend in opposite directions and at different levels from a point of attachment to the bar-shaped means, and a third plate-shaped part fixed to the bar-shaped means and extending at least substantially perpendicularly to said first and second plate-shaped parts.

6. A device according to claim 1 wherein a free edge of said plate-shaped parts is bent.

7. A device according to claim 1 wherein said plate-shaped parts are provided with perforations and wherein said bar-shaped means are hollow.

* * * * *